US006150915A

United States Patent [19]

O'Reilly et al.

[11] Patent Number: 6,150,915

[45] Date of Patent: Nov. 21, 2000

[54] MAGNETIC COMPONENTS AND THEIR PRODUCTION

[75] Inventors: Stephen O'Reilly; Maeve Duffy; Terence O'Donnell; Sean Cian O'Mathuna, all of Cork, Ireland

[73] Assignee: National University of Ireland, Cork, Cork, Ireland

[21] Appl. No.: 09/215,172

[22] Filed: Dec. 18, 1998

[30] Foreign Application Priority Data

Dec. 18, 1997 [IE] Ireland ..... S970893

[51] Int. Cl.[7] ..... H01F 27/28

[52] U.S. Cl. ..... 336/232; 336/200

[58] Field of Search ..... 336/200, 221, 336/232

[56] References Cited

U.S. PATENT DOCUMENTS

| | | | |
|---|---|---|---|
| 3,898,595 | 8/1975 | Launt | 335/152 |
| 5,552,756 | 9/1996 | Ushiro | 336/200 |
| 5,726,615 | 3/1998 | Bloom | 336/83 |
| 5,745,981 | 5/1998 | Roshen et al. | 29/607 |
| 5,781,091 | 7/1998 | Krone et al. | 336/200 |

FOREIGN PATENT DOCUMENTS

| | | |
|---|---|---|
| 57-066522 | 4/1982 | Japan . |
| 61-075510 | 4/1986 | Japan . |
| 61-216314 | 9/1986 | Japan . |
| 06215962 | 8/1994 | Japan . |

OTHER PUBLICATIONS

Yamaguchi et al, Characteristics of a Thin Film Microtransformer . . . , IEEE Transactions on Magnetics, vol. 29, No. 5, Sep. 1993.

*Primary Examiner*—Ray Barrera
*Attorney, Agent, or Firm*—Jacobson, Price, Holman & Stern PLLC

[57] ABSTRACT

A magnetic component (20) has conductor windings (22*a*, 22*b*) surrounded by insulation (21). In addition, the component (20) has a magnetic plate (23*a*, 23*b*) on each side. This is applied using conventional PCB process techniques. The magnetic plates enhance the inductance of the component in a manner which may be controlled by setting the configuration of the plates. For example a plate may have a number of isolated sections. Also, the plates on each side may be interconnected by plated through holes to provide a closed core.

25 Claims, 3 Drawing Sheets

MAGNETIC COMPONENTS AND THEIR PRODUCTION

INTRODUCTION

1. Field of the Invention

The invention relates to construction of magnetic components such as inductors and transformers, and to methods for producing them.

2. Prior Art Discussion

Traditionally, such components have been produced by winding wire in various configurations. However, such a process can be labour intensive and repeatability is difficult, leading to wide tolerances.

It is also known to use planar material to produce magnetic components. For example, U.S. Pat. No. 3,898,595 (Cunningham Corporation) describes lamination of steel foils onto a baseboard and being patterned to form core shapes for reed relays, inductors, and transformers. Windings are formed by connecting conductor tracks on layers above and below the core layer by plated conductor through holes. Also, European Patent Specification No. EP756298 (Autosplice Systems) describes a process for producing magnetic components in which an insulating layer is cut out to provide recesses into which a toroidal core is added. In general, it appears that approaches which use planar materials tend to be quite complex. For example two plated through holes are required for each turn. It appears that there would be little flexibility in the manner in which characteristics of the component may be set by choice of production parameters.

OBJECTS OF THE INVENTION

One object is to provide a construction of magnetic component which provides good performance characteristics and which has a relatively flat profile.

Another object is that the component be easily integrated into a circuit board.

Another object is to provide a component production method which involves using conventional multilayer printed circuit board production techniques.

A still further object is to provide improved flexibility in choice of operating characteristics set by design and manufacturing parameters.

SUMMARY OF THE INVENTION

According to the invention, there is provided a magnetic component comprising:

a planar conductor shaped according to a component winding pattern;

an insulating layer over the conductor; and a magnetic plate over the insulating layer.

Such a component provides excellent inductance characteristics

In one embodiment, the component comprises an insulating layer and a magnetic plate on both sides of the conductor.

Preferably, the magnetic plates are interconnected by magnetic material to provide a closed core. Ideally, the magnetic plates are interconnected by plated through holes.

In another embodiment, the magnetic plate comprises a plurality of isolated sections.

In one embodiment, corresponding sections on both sides of the component are interconnected by magnetic material.

In one embodiment, the sections are shaped as disc sectors.

In one embodiment, the sectors are shaped as quadrants. In one embodiment, the magnetic plate is of NiFe material.

In one embodiment, the component comprises a plurality of magnetic plates separated by insulation on a side of the conductor.

According to another aspect, the invention provides a method of producing a magnetic component, the method comprising the steps of:

applying a planar conductor in a component winding pattern;

applying an insulating layer over the conductor; and applying a magnetic plate over the insulating layer in a pattern to set characteristics of the magnetic component.

This method produces a magnetic component having excellent inductance characteristics. Also, by applying the magnetic plate in a pattern as described, the characteristics of the component may be set in a very simple and predictable manner.

Preferably, a plurality of conductors and associated insulating layers are formed, and the patterned magnetic plate is applied over an outer conductor.

In one embodiment, an insulating layer and a magnetic plate are applied on both sides of the conductor.

In one embodiment, the magnetic plates are interconnected with magnetic material to provide a closed core.

Preferably, the plates are interconnected by plated through holes isolated from the conductor.

In one embodiment, the magnetic plate is applied as a plurality of isolated sections.

Preferably, the sections are shaped as disc sectors.

Preferably, the conductor. the insulating layer and the magnetic plate are applied in steps for producing a multilayer circuit board whereby the component is integrated into the board.

BRIEF DESCRIPTION OF THE DRAWINGS

The invention will be more clearly understood from the following description of some embodiments thereof, given by way of example only with reference to the accompanying drawings in which.

DETAILED DESCRIPTION OF THE INVENTIONS

Figure 1:
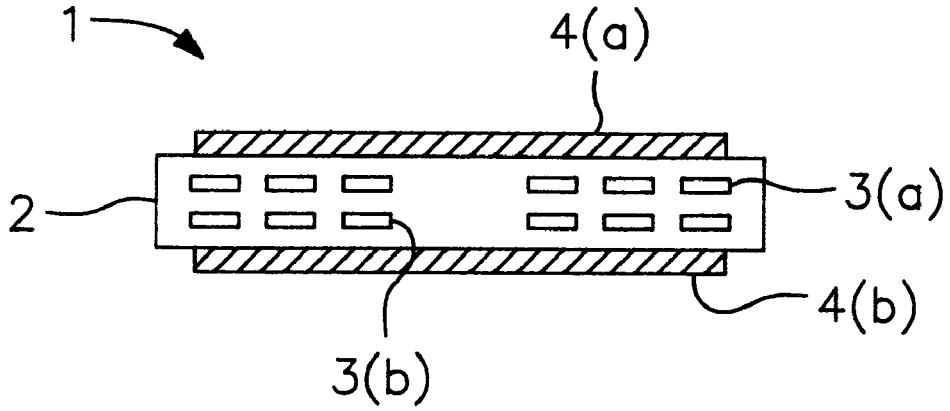
FIG. 1 is a diagrammatic cross-sectional view of a magnetic component of the invention.
Figure 2:
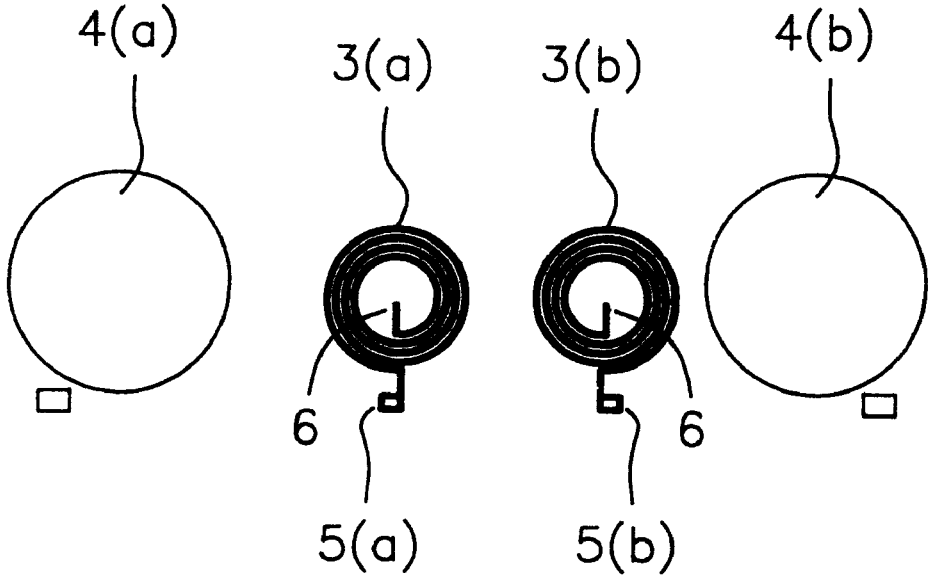
FIG. 2 is a set of plan views showing parts of the component of FIG. 1 in more detail.

Referring to the drawings and initially to FIGS. 1 and 2 there is shown a magnetic component 1 of the invention. The component 1 is integrated in a multilayer printed circuit board. It is produced using conventional multilayer printed circuit board production techniques because of the construction of the component itself. These production techniques are conventional and are not described in this document and instead the construction of the components is described in detail, from which it is clear why conventional multilayer circuit production techniques may be used.

The component 1 comprises a "prepreg" insulator 2 which supports two planar conductors 3(*a*) and 3(*b*), each of which is in the shape of a spiral winding as shown in FIG. 2. The insulator 2 insulates the windings of the conductors 3(*a*) and 3(*b*). The component 1 also comprises patterned magnetic plates 4(*a*) and 4(*b*) at the top and bottom sides of the component 1. Finally, the conductors 3(*a*) and 3(*b*) comprise leads 5(*a*) and 5(*b*) respectively and a through-hole connection so that they are interconnected. The conductors 3(*a*) and 3(*b*) are of copper material and they provide the windings of the component 1.

The magnetic plates 4(*a*) and 4(*b*) are of NiFe ("permalloy") material.

The component 1 is produced by sequentially applying a conductor 3(*a*) or 3(*b*), an insulating layer, and subsequently a magnetic layer 4(*a*) or 4(*b*). These operations are performed in both directions to provide the symmetrical structure illustrated. However, the structure may not be symmetrical and may include only one magnetic plate. At its simplest, therefore, the component may have a single conductor, a single insulating layer over the conductor, and a single patterned magnetic plate over the insulating layer. Also, the component may comprise a number of conductor/insulating layer pairs. It will be appreciated that the overall structure of the component is achieved by using conventional multilayer printed circuit board production techniques by simply bonding various layers as required to provide the component configuration.

The presence of the patterned magnetic plates 4(*a*) and 4(*b*) enhances inductance by providing a low reluctance path to magnetic flux around the conductor windings. The inductance characteristics of the component may be controlled by the choice of configuration of the or each magnetic plate. This provides a highly active and predictable level of control in a simple manner because it is achieved by simple plating and patterning steps.

Figure 3:
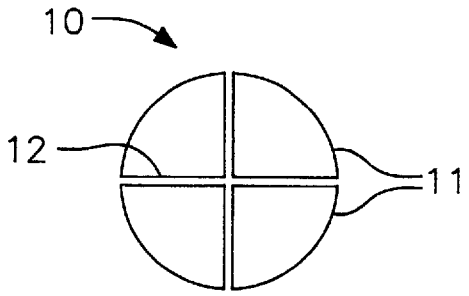
FIG. 3 is a plan view of an alternative magnetic plate for a magnetic component of the invention.

Referring now to FIG. 3, the magnetic plate may be patterned to comprise a number of isolated sections. In this way, there is no complete path for eddy-currents to flow in opposition to currents flowing in the conductors windings. The purpose of patterning in this way is to disrupt eddy current flow so as to help prevent inductance reduction with frequency. In the embodiment of FIG. 3 a magnetic plate 10 comprises four isolated quadrant-shaped sectors 11 separated by radially extending gaps 12. The number of sections may be varied to set the inductance characteristics of the component. There is, of course, a trade off between the number of sections and the area of magnetic plate provided and an optimum configuration can be easily found for each type of component.

It will be appreciated that the invention provides for setting of inductance characteristics of the component by configuring the manner in which the magnetic plate is patterned over the insulation. This configuration may be achieved by using simple and conventional patterning techniques which are well know in the multilayer printed circuit board production industry.

Figure 4:
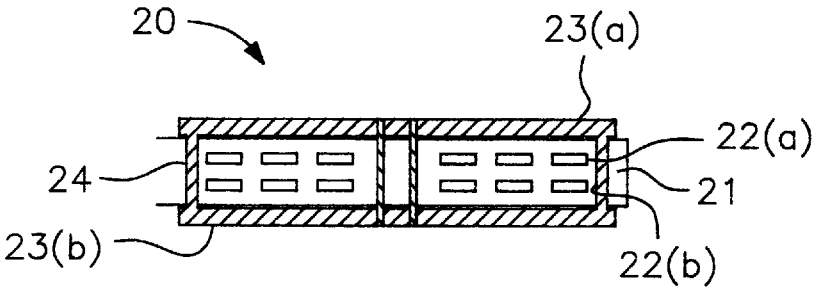
FIG. 4 is a diagrammatic cross-sectional view of an alternative magnetic component of the invention.
Figure 5:
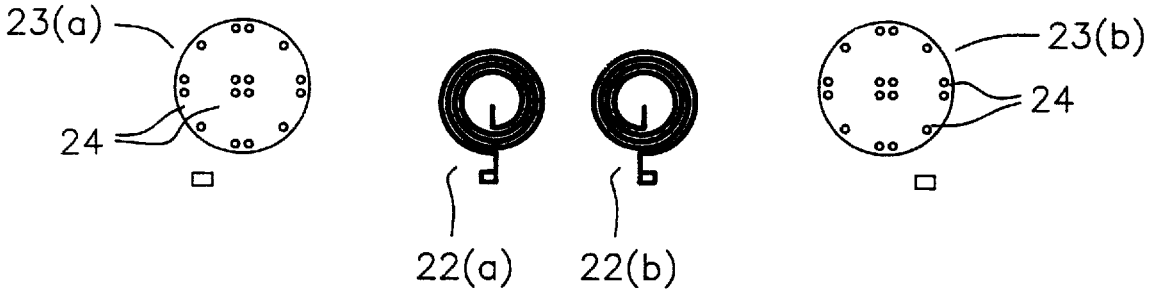
FIG. 5 is a set of plan views showing parts of the component of FIG. 4 in more detail.
Figure 6:
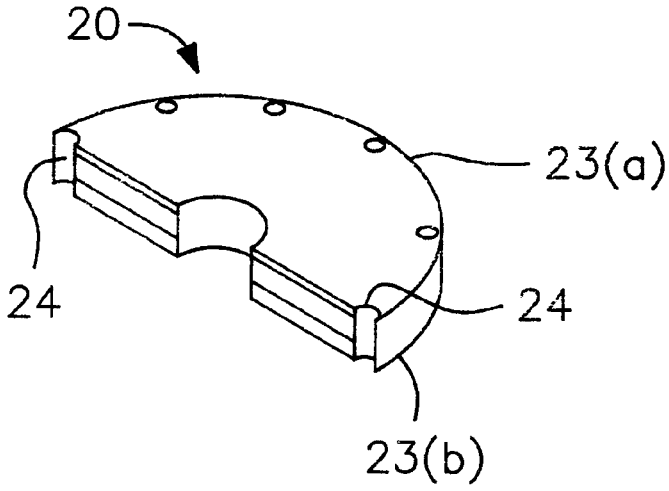
FIG. 6 is a diagrammatic perspective view showing a magnetic component of FIG. 4.

Another option which is available to set the inductance characteristics is to provide a closed core by interconnecting the magnetic plates of both sides of the component. Such a scenario is illustrated in FIGS. 4 to 7 inclusive. In FIG. 4 there is shown a magnetic component 20 comprising insulation 21 and a pair of copper conductors 22(*a*) and 22(*b*) in a spiral configuration, as for the component 1 shown in FIG. 1. The component 20 also comprises magnetic plates 23(*a*) and 23(*b*) which are interconnected by through holes 24 which are plated with magnetic material.

Figure 7:
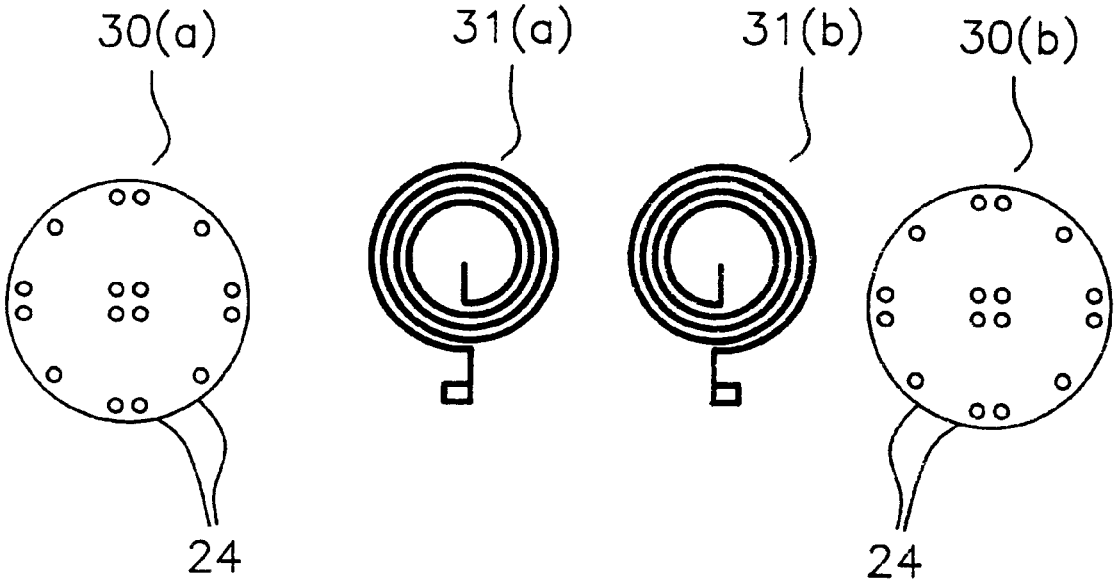
FIG. 7 is a set of plan views of parts of a still further construction of magnetic component of the invention.

Interconnection of the magnetic plates provides a closed magnetic path so larger inductance values per unit area are achieved than for open-core structures. The high frequency performance of the component may be improved by patterning the magnetic plates as shown in FIG. 7. In FIG. 7, magnetic plates 30(*a*) and 30(*b*) are illustrated which comprise four quadrants as for the magnetic plate 10 shown in FIG. 3. The magnetic plates 30(*a*) and 30(*b*) are used with conductor windings 31(*a*) and 31(*b*).

It will be appreciated that the invention provides a very simple method for producing a magnetic component because conventional PCB processing techniques may be used. Also, the invention provides excellent control at the production stage because operating characteristics within a wide frequency range may be chosen by configuring the magnetic plate or plates as appropriate. This is achieved using conventional patterning techniques. Particularly good results are achieved at lower frequencies. At higher frequencies the inductance drops due to the conductivity of the magnetic plates, however, due to the magnetic plate patterning the results still represent an improvement over a component without magnetic material. Also, the invention achieves a component having a relatively flat profile.

The benefits of the invention are now illustrated with reference to the table below. This table reflects the results of measuring inductance for five prototype components as follows:

(a) a component without magnetic material, (b) a component having an architecture as illustrated in FIG. 1, (c) a component having plates with sections as shown in FIG. 3, (d) a component having a closed core, and (e) a component having magnetic plates as shown in FIG. 7 to provide a patterned closed core.

In all cases, the conductor windings comprise a two-layer circular spiral with 13 turns per layer. The spiral has a track width and spacing of 100 μm and an outer diameter of 8.5 mm. The magnetic layer has a circular outline with an outer diameter of 10 mm. For the patterned components, the top and bottom magnetic layers are divided into four quadrants.

| | 1 kHz | 10 kHz | 100 kHz | 1 MHz |
|---|---|---|---|---|
| (a) | 4.4 μH | 3.87 μH | 3.78 μH | 3.77 μH |
| (b) | 11.3 μH | 10.4 μH | 2.6 μH | 0.28 μH |
| (c) | 11.3 μH | 10.8 μH | 9.76 μH | 4.2 μH |
| (d) | 38.8 μH | 14.1 μH | 2.11 μH | 0.27 μH |
| (e) | 93 μH | 31.4 μH | 11.55 μH | 4.3 μH |

The results for 1 kHz illustrate how beneficial it is to pattern the magnetic layers and use magnetic plated through holes. The inductance increases from 4.4 μH to 93 μH for a patterned closed core. As is clear from the right-hand column, the inductance is lower at higher frequencies, however, patterning achieves a performance comparable with components with no magnetic material. The production method may therefore be applied for a wide component frequency range.

The invention is not limited to the embodiments described. The magnetic plates may be configured using conventional processing techniques to any shape or configuration desired to achieve the required inductance for the frequency of operation. For example, the layers may be applied in any suitable manner instead of bonding, such as by lamination. Also, multiple magnetic plates may be applied on each side, insulated from each other. This will provide a method to obtain high inductance values across a wide frequency range. In addition to the design patterning, further patterning may be carried out in order to trim inductance values, e.g. by using a laser. This type of patterning could be carried out in order to improve inductance tolerance or to provide in-circuit tuning of the component.

What is claimed is:

1. A magnetic component comprising:

a planar conductor shaped according to a component winding pattern;

an insulating layer over the planar conductor;

a magnetic plate over the insulating layer; said magnetic plate comprises a plurality of isolated sections; and wherein the sections are shaped as disc sectors.

2. A component as claimed in claim 1, wherein the component comprises an insulating layer and a magnetic plate on both sides of the conductor.

3. A component as claimed in claim 2, wherein the magnetic plates are interconnected by magnetic material to provide a closed core.

4. A component as claimed in claim 3, wherein the magnetic plates are interconnected by plated through holes.

5. A component as claimed in claim 3, wherein corresponding sections of said plurality of isolated sections on both sides of the component are interconnected.

6. A component as claimed in claim 1, wherein the sectors are shaped as quadrants.

7. A component as claimed in claim 1, wherein the magnetic plate is of NiFe material.

8. A component as claimed in claim 1, comprising a plurality of magnetic plates separated by insulation on a side of the conductor.

9. A method of producing a magnetic component, the method comprising the steps of:

applying a planar conductor in a component winding pattern;

applying an insulating layer over the planar conductor;

applying a magnetic plate over the insulating layer in a pattern to set characteristics of the magnetic component; wherein the magnetic plate comprises a plurality of isolated sections; and wherein the sections are shaped as disc sectors.

10. A method as claimed in claim 9, wherein a plurality of conductors and associated insulating layers are formed, and the patterned magnetic plate is applied over an outer conductor.

11. A method as claimed in claim 9, wherein an insulating layer and a magnetic plate are applied on both sides of the conductor.

12. A method as claimed in claim 11, wherein the magnetic plates are interconnected with magnetic material to provide a closed core.

13. A method as claimed in claim 12, wherein the plates are interconnected by plated through holes isolated from the conductor.

14. A method as claimed in claim 9, wherein the conductor, the insulating layer and the magnetic plate are applied in steps for producing a multilayer circuit board whereby the component is integrated into the board.

15. A method as claimed in claim 9, comprising the further steps of applying a plurality of magnetic plates separated by insulating layers.

16. A process for producing a multilayer printed circuit board, integrating a magnetic component into the board by performing the steps of:

applying a planar conductor between circuit board insulating layers, the planar conductor having a component winding pattern;

applying a magnetic plate over the insulating layers on each side of the planar conductor in a pattern to set characteristics of the magnetic component; and interconnecting the magnetic plates with through holes plated with magnetic material, the plated through holes extending through the insulating layers and being isolated from the planar conductor.

17. The process as claimed in claim 16, performing the additional steps of applying at least one additional planar conductor between the magnetic plates; and insulating the planar conductor with board insulating layers.

18. The process as claimed in claim 16, performing the additional steps of applying at least one additional magnetic plate; and insulating each such plate with board insulating layers.

19. The process as claimed in claim 16, applying each magnetic plate in a pattern comprising a plurality of isolated magnetic plate sections.

20. The process as claimed in claim 19, applying each magnetic plate in a pattern comprising a plurality of isolated magnetic plate sections shaped as disc sectors.

21. A multilayer circuit board comprising a plurality of insulating layers and a magnetic component comprising:

at least one planar conductor having a component winding pattern and being isolated by circuit board insulating layers; and magnetic plates on each side of the planar conductor and being isolated from the planar conductor by circuit board insulating layers, the magnetic plates being interconnected by through holes which are plated with magnetic material extend through the insulating layers.

22. The multilayer circuit board as claimed in claim 21, wherein the magnetic component comprises a plurality of planar conductors between the magnetic plates.

23. The multilayer circuit board as claimed in claim 22, wherein the magnetic component comprises at least one additional magnetic plate between said magnetic plates.

24. The multilayer circuit board as claimed in claim 21, wherein each magnetic plate is in a pattern comprising a plurality of isolated sections.

25. The multilayer circuit board as claimed in claim 24, wherein the sections are shaped as disc sectors.

* * * * *